US005449581A

United States Patent [19]

Matsui et al.

[11] Patent Number: 5,449,581

[45] Date of Patent: Sep. 12, 1995

[54] PHTHALOCYANINE COMPOSITION, PROCESS FOR PREPARING THE SAME, ELECTROPHOTOGRAPHIC PHOTORECEPTOR USING THE SAME AND COATING SOLUTION FOR CHARGE GENERATION LAYER CONTAINING THE SAME

[75] Inventors: Megumi Matsui; Shigeru Hayashida; Takayuki Akimoto; Mikio Itagaki, all of Ibaraki, Japan

[73] Assignee: Hitachi Chemical Co., Ltd., Tokyo, Japan

[21] Appl. No.: 174,281

[22] Filed: Dec. 28, 1993

[30] Foreign Application Priority Data

Mar. 18, 1993 [JP] Japan ..... 5-058511

[51] Int. Cl.[6] ..... G03G 5/047

[52] U.S. Cl. ..... 430/59; 430/76; 430/78; 540/140

[58] Field of Search ..... 430/78, 58, 59, 73, 430/76; 540/140, 141

[56] References Cited

U.S. PATENT DOCUMENTS 5,286,587 2/1994 Ashiya ..... 430/58

5,304,445 4/1994 Itagaki et al. ..... 430/58

*Primary Examiner*—John Goodrow

*Attorney, Agent, or Firm*—Antonelli, Terry, Stout & Kraus

[57] ABSTRACT

Disclosed are a phthalocyanine composition which comprises having main diffraction peaks at 7.5°, 24.2° and 27.3° of Bragg angles ($2\theta \pm 0.2°$) in an X-ray diffraction spectrum with Cu K$\alpha$, a process for preparing the same, an electrophotographic photoreceptor using the same and a coating solution for forming a charge generation layer containing the same.

12 Claims, 7 Drawing Sheets

PHTHALOCYANINE COMPOSITION, PROCESS FOR PREPARING THE SAME, ELECTROPHOTOGRAPHIC PHOTORECEPTOR USING THE SAME AND COATING SOLUTION FOR CHARGE GENERATION LAYER CONTAINING THE SAME

BACKGROUND OF THE INVENTION

This invention relates to a novel phthalocyanine composition having high sensitivity, a process for preparing the same, an electrophotographic photoreceptor using the same and a coating solution for forming a charge generation layer containing the same.

As a conventional electrophotographic photoreceptor, there may be mentioned a photoreceptor in which about 50 μm of a selenium (Se) film is formed on a conductive substrate such as aluminum by a vacuum vapor deposition method. However, this Se photoreceptor has a problem that it has sensitivity only up to a wavelength of around 500 nm. Further, there may be mentioned a photoreceptor in which about 50 μm of an Se layer is formed on a conductive substrate, and several μm of a selenium-tellurium (Se-Te) alloy layer is further formed thereon. Whereas this photoreceptor has spectral sensitivity to a longer wavelength as the Te content of the above Se-Te alloy is higher, property of maintaining surface charge becomes worse as the amount of Te added is increased. Thus, there is a serious problem that it cannot be used practically as a photoreceptor.

Also, there may be mentioned the so-called composite two layer type photoreceptor in which a charge generation layer is formed on an aluminum substrate by coating about 1 μm of Chlorocyan Blue or a squaraine derivative, and a charge transport layer is formed thereon by coating 10 to 20 μm of a mixture of polyvinylcarbazole or a pyrazoline derivative and a polycarbonate resin having high insulation resistance. However, this photoreceptor does not have sensitivity to light of 700 nm or more as a matter of fact.

In recent years, there have been reported many composite two layer type photoreceptors in which the above drawbacks have been canceled, that is, those having sensitivity at around 800 nm which is the wavelength of a diode laser oscillation region. However, in many of these, a phthalocyanine pigment is used as a charge generating material, and on a charge generation layer having a film thickness of about 0.5 to 1 μm, a charge transport layer is formed by coating 10 to 20 μm of a mixture having high insulation resistance and comprising a polyvinylcarbazole, a pyrazoline derivative or a hydrazone derivative and a polycarbonate resin or a polyester resin to form a composite two layer type photoreceptor.

In phthalocyanines, not only absorption spectrum and photoconductivity vary depending on central metals, but also these physical properties vary depending on crystal forms. There have been reported several examples of phthalocyanines in which the same central metal is used, but a specific crystal form is selected for an electrophotographic photoreceptor.

For example, there has been reported that various crystal forms exist in titanylphthalocyanines, and charging characteristics, dark decay and sensitivity vary greatly depending on the difference of their crystal forms.

In Japanese Provisional Patent Publication No. 49544/1984, it has been described that a crystal form of titanylphthalocyanine giving strong diffraction peaks at 9.2°, 13.1°, 20.7°, 26.2° and 27.1° of Bragg angles ($2\theta \pm 0.2°$) is preferred, and an X-ray diffraction spectrum chart is shown. Electrophotographic characteristics of a photoreceptor using the titanylphthalocyanine having the crystal form as a charge generating material are dark decay (DDR) of 85% and sensitivity ($E_{\frac{1}{2}}$) of 0.57 lux.sec.

Also, in Japanese Provisional Patent Publication No. 166959/1984, a charge generation layer is obtained by allowing a vapor deposited film of titanylphthalocyanine to stand in tetrahydrofuran-saturated vapor for 1 to 24 hours to change a crystal form. It has been shown that the X-ray diffraction spectrum shows a smaller number of wide peaks and gives strong diffraction peaks at 7.5°, 12.6°, 13.0°, 25.4°, 26.2° and 28.6° of Bragg angles ($2\theta \pm 0.2°$). Electrophotographic characteristics of a photoreceptor using the titanylphthalocyanine having the crystal form as a charge generating material are dark decay (DDR) of 86% and sensitivity ($E_{\frac{1}{2}}$) of 0.7 lux.sec.

In Japanese Provisional Patent Publication No. 198452/1990, it has been described that a crystal form of titanylphthalocyanine having a main diffraction peak at 27.3° of Bragg angles ($2\theta \pm 0.2°$) has high sensitivity (1.7 $mJ/m^2$) and can be prepared by stirring in a mixed solution of water and o-dichlorobenzene under heating at 60° C. for one hour.

In Japanese Provisional Patent Publication No. 256059/1990, it has been described that a crystal form of titanylphthalocyanine having a main diffraction peak at 27.3° of Bragg angles ($2\theta \pm 0.2°$) has high sensitivity (0.62 lux.sec) and can be prepared by stirring in 1,2-dichloroethane at room temperature.

Thus, the phthalocyanines are different in electrophotographic characteristics depending on the difference of crystal forms and the crystal form is an important factor for deciding characteristics of an electrophotographic photoreceptor.

In Japanese Provisional Patent Publication No. 194257/1987, there has been reported an example using two kinds or more of phthalocyanines and it has been described that a mixture of titanylphthalocyanine and a non-metal phthalocyanine is used as a charge generating material.

As described above, titanylphthalocyanine exhibits extremely high sensitivity and excellent characteristics by changing a crystal form. However, in a laser printer for which it is used, higher quality and higher precision have been achieved, and an electrophotographic photoreceptor having further high sensitivity characteristic has been demanded.

SUMMARY OF THE INVENTION

An object of the present invention is to provide a phthalocyanine composition having high sensitivity, a process for preparing the same, an electrophotographic photoreceptor using the same and a coating solution for a charge generation layer containing the same.

The present invention relates to a phthalocyanine composition which comprises having main diffraction peaks at 7.5°, 24.2° and 27.3° of Bragg angles ($2\theta \pm 0.2°$) in an X-ray diffraction spectrum with Cu Kα.

Also, the present invention relates to a process for preparing a phthalocyanine composition having main diffraction peaks at 7.5°, 24.2° and 27.3° of Bragg angles ($2\theta \pm 0.2°$) in an X-ray diffraction spectrum with Cu Kα, which comprises precipitating a phthalocyanine mixed crystal containing titanylphthalocyanine and a halogenated metal phthalocyanine in which a central metal is trivalent in water by an acid pasting method to obtain precipitates having a characteristic diffraction peak at 27.2° of Bragg angles ($2\theta \pm 0.2°$) in an X-ray diffraction spectrum with Cu Kα, and subsequently treating these precipitates with a mixed solvent of an aromatic organic solvent and water.

Further, the present invention relates to an electrophotographic photoreceptor having a photoconductive layer containing an organic photoconductive substance on a conductive substrate, in which the organic photoconductive substance is a phthalocyanine composition having main diffraction peaks at 7.5°, 24.2° and 27.3° of Bragg angles ($2\theta \pm 0.2°$) in an X-ray diffraction spectrum with Cu Kα.

Further, the present invention relates to a coating solution for forming a charge generation layer containing the phthalocyanine composition obtained by the above preparation process.

Generally speaking, a phthalocyanine mixture is a mere physical mixture of two or more phthalocyanines used as starting materials and an X-ray diffraction pattern of the phthalocyanine mixture comprises piled up (sum) peak patterns of respective phthalocyanines used as starting materials. On the other hand, the phthalocyanine composition of the present invention is a mixed crystal of phthalocyanines used as starting materials in a molecular order and an X-ray diffraction pattern thereof is different from that of a pattern in which peak patterns of the respective phthalocyanines used as starting materials are piled up.

The term "mixed crystal" mentioned in the present specification means not a mere physical mixture but a crystal material comprising different kinds of phthalocyanines.

DESCRIPTION OF THE PREFERRED EMBODIMENTS

Figure 1:
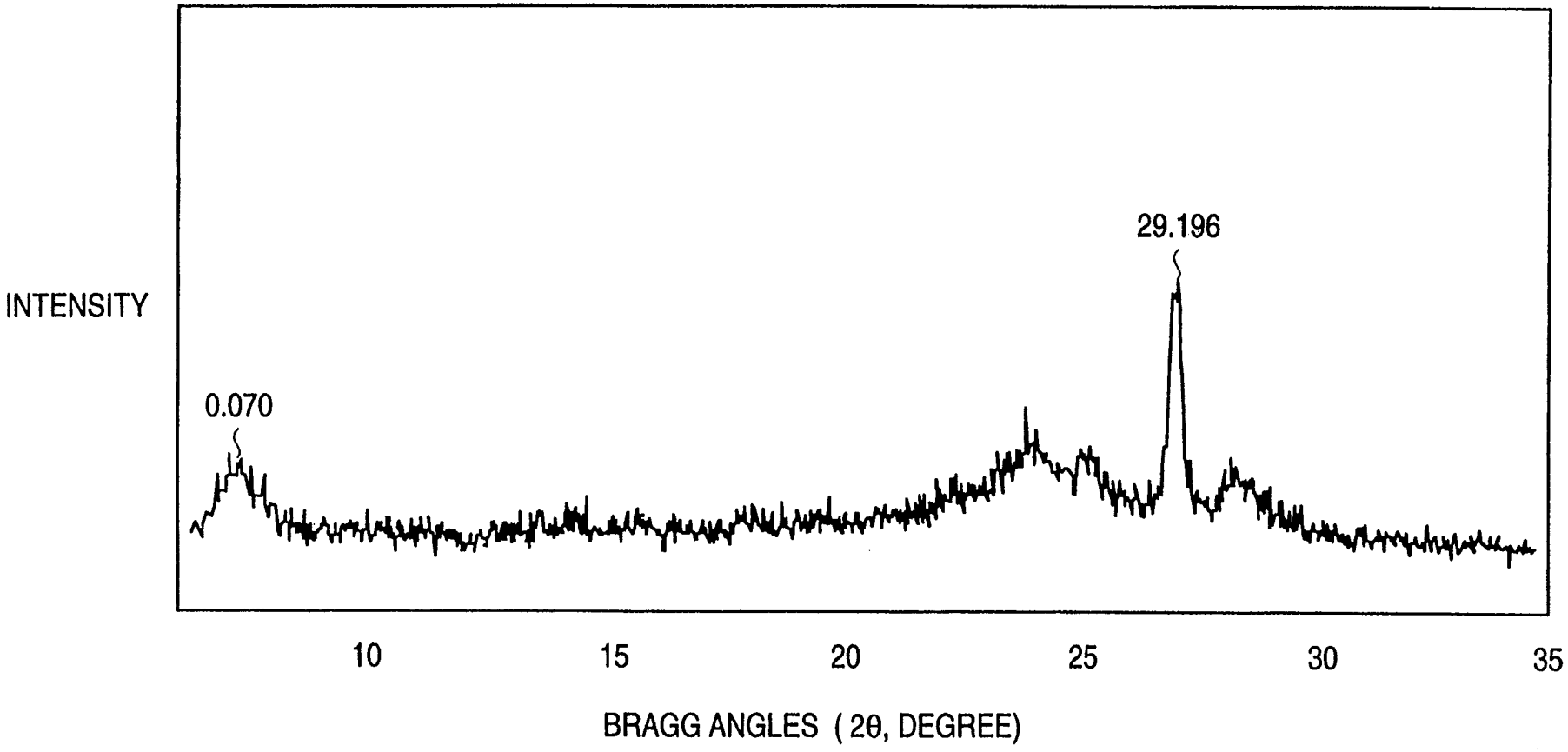
FIG. 1 is an X-ray diffraction spectrum of a product dried under vacuum obtained in Preparation example 1.

In the following, the present invention is described in detail.

The titanylphthalocyanine to be used in the present invention can be prepared, for example, as mentioned below.

To 120 ml of α-chloronaphthalene is added 18.4 g (0.144 mole) of phthalonitrile, and then 4 ml (0.0364 mole) of titanium tetrachloride is added dropwise to the mixture under nitrogen atmosphere. After the dropwise addition, the mixture is heated and reacted at 200° to 220° C. for 3 hours under stirring, and then the reaction mixture is filtered while heating at 100° to 130° C. and the residue is washed with α-chloronaphthalene and then with methanol. The residue is hydrolyzed (90° C., one hour) with 140 ml of a deionized water, and this operation is repeated until the solution becomes neutral. The residue is then washed with methanol. Subsequently, the residue was sufficiently washed with N-methyl-2-pyrrolidone of 100° C. and then washed with methanol. The compound thus obtained is dried by heating at 60° C. under vacuum to obtain titanylphthalocyanine (yield: 46%).

In the halogenated metal phthalocyanine compounds in which a central metal is trivalent to be used in the present invention, a trivalent metal as a central metal includes In, Ga and Al, and a halogen includes Cl and Br. Said compounds may have a substituent(s) such as a halogen on a phthalocyanine ring. These compounds are known compounds, and among them, for example, a synthetic method of monohalogen metal phthalocyanine and monohalogen metal halogen phthalocyanine is described in Inorganic Chemistry, 19, 3131 (1980) and Japanese Provisional Patent Publication No. 44054/1984.

The monohalogen metal phthalocyanine can be prepared by, for example, the following manner.

To 100 ml of quinoline distilled twice and deoxidized are added 78.2 mmole of phthalonitrile and 15.8 mmole of metal trihalide, and the mixture is refluxed under heating for 0.5 to 3 hours. After gradually cooled, the mixture is cooled to 0° C. and then filtered. The crystal is washed with methanol, toluene and then acetone, and dried at 110° C.

Further, the monohalogen metal halogen phthalocyanine can be prepared by the following manner. After 156 mmole of phthalonitrile and 37.5 mmole of metal trihalide are mixed and melted at 300° C., the mixture is heated for 0.5 to 3 hours to obtain a crude product of monohalogen metal halogen phthalocyanine. The product is washed with α-chloronaphthalene by using a Soxhlet extractor.

In the present invention, as to a composition ratio of the phthalocyanine mixture containing titanylphthalocyanine and a halogenated metal phthalocyanine in which a central metal is trivalent, the content of the titanylphthalocyanine is preferably in the range of 20 to 95% by weight, more preferably in the range of 50 to 90% by weight, particularly preferably in the range of 65 to 90% by weight, most preferably in the range of 75 to 90% by weight from the point of electrophotographic characteristics such as charging characteristics, dark decay and sensitivity.

The phthalocyanine mixture can be made amorphous by precipitating it in water by the acid pasting method.

For example, 1 g of the phthalocyanine mixture is dissolved in 50 ml of conc. sulfuric acid, and the mixture is stirred at room temperature. Subsequently, the mixture is added dropwise to 1 liter of a deionized water cooled with ice water over about one hour, preferably 40 minutes to 50 minutes to be precipitated. After left to stand overnight, the supernatant is removed by decantation, and then the precipitates are collected by centrifugation. Thereafter, the precipitates are washed repeatedly with a deionized water which is a washing water until the washing water after washing has a pH of 2 to 5, preferably a pH of about 3 and a conductivity of 5 to 500 μS/cm. Then, the precipitates are washed sufficiently with methanol, and dried by heating at 60° C. under vacuum to obtain powder (or mixed crystal) of a phthalocyanine composition.

The powder of the precipitates (or mixed crystal) comprising the titanylphthalocyanine and the halogenated metal phthalocyanine in which the central metal is trivalent formed as described above gives a clear diffraction peak at 27.2° of Bragg angles ($2\theta \pm 0.2°$) in an X-ray diffraction spectrum with Cu Kα, but other peaks are wide so that their values cannot be determined specifically.

If the pH exceeds 5, characteristic peak strength at 27.2° of Bragg angles ($2\theta \pm 0.2°$) in an X-ray diffraction spectrum with Cu Kα is lowered and a new peak stronger than the peak at 27.2° is formed at 6.8°. If a crystal form of such powder is changed by using a mixed solvent of an aromatic organic solvent and water, the composition having characteristic peaks at 7.5°, 24.2° and 27.3° of Bragg angles ($2\theta \pm 0.2°$) of the present invention cannot be obtained. A composition which does not have these characteristic peaks has poor sensitivity.

If the pH of the washing water after washing is less than 2 or exceeds 5, charging characteristics, dark decay and sensitivity tend to be poor, and if the conductivity of the washing water after washing is less than 5 μS/cm or exceeds 500 μS/cm, charging characteristics, dark decay and sensitivity tend to be poor.

By treating the precipitates thus obtained with a mixed solvent of an aromatic organic solvent and water to change the crystal form as mentioned below, the phthalocyanine composition of the present invention can be obtained.

A weight ratio of the aromatic organic solvent to water to be used is preferably 1/99 to 99/1, more preferably 50/50 to 99/1 from the point of changing efficiency of the crystal form. A ratio of the precipitates to water is preferably 1 to 50% by weight.

The treatment can be carried out by contacting the mixed solvent of the aromatic organic solvent and water of 20° C. to 100° C. with the precipitates for one hour or longer. As a contacting method, there may be used a means of stirring by a stirrer under heating or milling by a ball mill.

As the aromatic organic solvent to be used in the treatment, there may be mentioned, for example, benzene, toluene and xylene.

In the absorption spectrum of the phthalocyanine composition of the present invention, it is preferred that absorbance at 800 to 830 nm is larger than absorbance at 620 to 660 nm from the point of sensitivity.

The electrophotographic photoreceptor according to the present invention has a photoconductive layer provided on a conductive substrate.

In the present invention, the photoconductive layer is a layer containing an organic photoconductive substance, including a film of an organic photoconductive substance, a film containing an organic photoconductive substance and a binder, and a double-layered type film comprising a charge generation layer and a charge transport layer.

As the above organic photoconductive substance, the above phthalocyanine composition is used as an indispensable component, and further known pigments may be used in combination. Further, as the organic photoconductive substance, the above phthalocyanine composition is preferably used in combination of a charge generation substance (an organic pigment which generates a charge) and/or a charge transport substance. The above charge generation layer contains said phthalocyanine composition and/or a charge generation substance (an organic pigment which generates a charge), and the charge transport layer contains a charge transport substance.

As the above charge generation substance (an organic pigment which generates a charge), there may be used pigments which have been known to generate a charge, such as metallic or non-metallic type phthalocyanines having various crystalline structures, for example, α type, β type, γ type, δ type, ε type and χ type. The above charge generation substance may include azo pigments, anthraquinone pigments, indigoid pigments, quinacridone pigments, perillene pigments, polycyclic quinone pigments and methine pigments. These pigments have been disclosed in, for example, Japanese Provisional Patent Publications No. 37543/-1972, No. 37544/1972, No. 18543/1972, No. 18544/1972, No. 43942/1973, No. 70538/1973, No. 1231/1974, No. 105536/1974, No. 75214/1975, No. 44028/1978 and No. 17732/1979.

Further, τ, τ', η and η' type non-metallic phthalocyanines as disclosed in Japanese Provisional Patent Publication No. 182640/1983 and European Patent Publication No. 92,255 may be used. In addition to those described above, any organic pigment which generates a charge by irradiation of light may be used.

As the above charge transport substance, there may be mentioned a polymeric compound such as poly-N-vinylcarbazole, halogenated poly-N-vinylcarbazole, polyvinyl pyrene, polyvinyl indoloquinoxaline, polyvinyl benzothiophene, polyvinyl anthracene, polyvinyl acridine and polyvinyl pyrazoline, and a monomeric compound such as fluorenone, fluorene, 2,7-dinitro-9-fluorenone, 4H-indeno (1,2,6)-thiophen-4-one, 3,7-dinitro-dibenzothiophene-5-oxide, 1-bromopyrene, 2-phenylpyrene, carbazole, N-ethylcarbazole, 3-phenylcarbazole, 3-(N-methyl-N-phenylhydrazone)methyl-9-ethylcarbazole, 2-phenylindole, 2-phenylnaphthalene, oxadiazole, 2,5-bis(4-diethylaminophenyl)-1,3,4-oxadiazole, 1-phenyl-3-(4-diethylaminostyryl)-5-(4-diethylaminostyryl)-5-(4-diethylaminophenyl)pyrazoline, 1-phenyl-3-(p-diethylaminophenyl)pyrazoline, p-(dimethylamino)-stilbene, 2-(4-dipropylaminophenyl)-4-(4-dimethylaminophenyl)-5-(2-chlorophenyl)-1,3-oxazole, 2-(4-dimethylaminophenyl)-4-(4-dimethylaminophenyl)-5-(2-fluorophenyl)-1,3-oxazole, 2-(4-diethylaminophenyl)-4-(4-dimethylaminophenyl)-5-(2-fluorophenyl)-1,3-oxazole, 2-(4-dipropylaminophenyl)-4-(4-dimethylaminophenyl)-5-(2-fluorophenyl)-1,3-oxazole, imidazole, chrysene, tetraphene, acridene, triphenylamine, benzidine and derivatives thereof. As the charge transport substance, benzidine derivatives are preferred, and among them, the benzidine derivative represented by the formula (I) is particularly preferred.

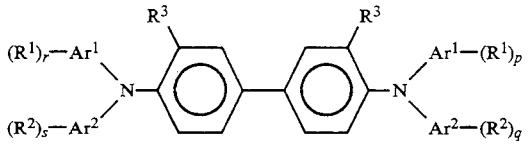

(I)

wherein $R^1$ and $R^2$ each independently represent a hydrogen atom, a halogen atom, an alkyl group, an alkoxy group, an aryl group, a fluoroalkyl group or a fluoroalkoxy group, two $R^3$s each independently represent a hydrogen atom or an alkyl group, $Ar^1$ and $Ar^2$ each independently represent an aryl group, and p, q, r and s each independently represent an integer of 0 to 5.

In the formula (I), the alkyl group may include those having 1 to 4 carbon atoms such as a methyl group, an ethyl group, an n-propyl group, an iso-propyl group, an n-butyl group and a tert-butyl group. The alkoxy group may include those having 1 to 3 carbon atoms such as a methoxy group, an ethoxy group, an n-propoxy group and an iso-propoxy group. The aryl group may include a phenyl group, a tolyl group, a biphenyl group, a terphenyl group and a naphthyl group. The fluoroalkyl group may include those having 1 to 3 carbon atoms such as a trifluoromethyl group, a trifluoroethyl group and a heptafluoropropyl group. The fluoroalkoxy group may include those having 1 to 4 carbon atoms such as a trifluoromethoxy group, a 2,3-difluoroethoxy group, a 2,2,2-trifluoroethoxy group, a 1H, 1H-pentafluoropropoxy group, a hexafluoro-iso-propoxy group, a 1H,1H-pentafluorobutoxy group, a 2,2,3,4,4,4-hexafluorobutoxy group and a 4,4,4-trifluorobutoxy group. Specific examples of the benzidine derivative represented by the formula (I) may include Compounds No. 1 to No. 6 shown below.

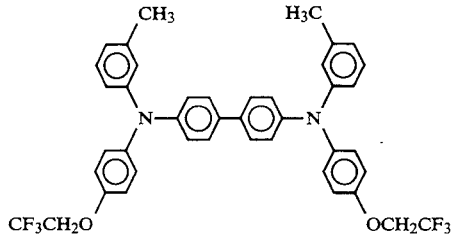

No. 1

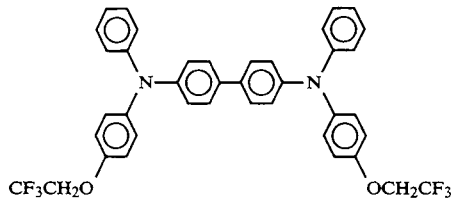

No. 2

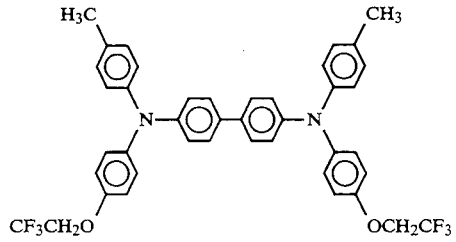

No. 3

-continued

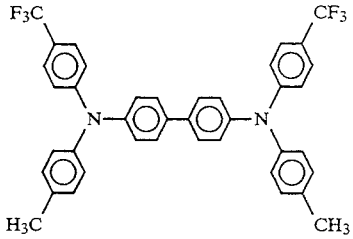

No. 4

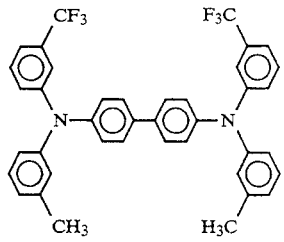

No. 5

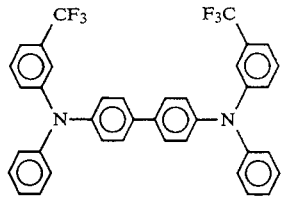

No. 6

When a mixture of the above phthalocyanine composition and, if necessary, the charge generation substance (an organic pigment which generates a charge) (these are called the former), and the charge transport substance (this is called the latter) is used (when a single layer type photoconductive layer is formed), a weight ratio of the latter/the former to be formulated is preferably within the range of 10/1 to 2/1. Here, a binder is preferably used in an amount of 0 to 500% by weight, particularly in the range of 30 to 500% by weight based on the total amount of these compounds (the former + the latter). When the binder is used, an additive such as a plasticizer, a flowability imparting agent and a pinhole preventing agent may be further added, if necessary.

When the double-layered type photoconductive layer comprising the charge generation layer and the charge transport layer is formed, the charge generation layer contains the above phthalocyanine composition and, if necessary, the charge generation substance (an organic pigment which generates a charge). A binder may be contained in the charge generation layer in an amount of 0 to 500% by weight, preferably 30 to 500% by weight based on the total amount of the phthalocyanine composition and the charge generation substance, and the above additives may be added in an amount of 0.1 to 5% by weight, preferably 0.1 to 2% by weight based on the total amount of the phthalocyanine composition and the charge generation substance. Further, in the charge transport layer, the charge transport substance described above is contained, and a binder may be contained in an amount of 30 to 500% by weight, preferably 50 to 300% by weight based on the charge transport substance. When the charge transport substance is a monomeric compound, a binder is preferably contained in an amount of 50 to 500% by weight, preferably 50 to 300% by weight based on said compound.

As the binder which can be used for all cases described above, there may be mentioned a silicone resin, a polyamide resin, a polyurethane resin, a polyester resin, an epoxy resin, a polyketone resin, a polycarbonate resin, a polyvinyl butyral resin, a polyacrylic resin, a polystyrene resin, a melamine resin, a styrene-butadiene copolymer, a poly(methyl methacrylate) resin, a polyvinyl chloride, an ethylene-vinyl acetate copolymer, a vinyl chloride-vinyl acetate copolymer, a polyacrylamide resin, a polyvinylcarbazole, a polyvinyl pyrazoline and a polyvinyl pyrene. Further, a thermosetting resin and a photocuring resin which are cross-linked by heat and/or light may be also used.

In either case, the binder is not particularly limited so long as it is a resin which has insulation property and can form a film under normal conditions, and a resin which is cured by heat and/or light to form a film.

The plasticizer which is the additive described above may include paraffin halide, dimethylnaphthalene and dibutylphthalate, the flowability imparting agent may include Modaflow (trade name, produced by Monsant Chemical Co.) and Akulonal 4F (trade name, produced by BASF Co.), and the pinhole preventing agent may include benzoin and dimethylphthalate. These may be suitably selected and used, and the amounts thereof may be suitably determined.

In the present invention, the conductive substrate is a conductive member such as a paper or a plastic film subjected to conductive treatment, a plastic film on which a metal foil such as aluminum is laminated and a metal plate.

The electrophotographic photoreceptor of the present invention comprises a photoconductive layer formed on a conductive substrate. The thickness of the photoconductive layer is preferably 5 to 50 μm. When a double-layered type photoconductive layer comprising a charge generation layer and a charge transport layer is used, the charge generation layer preferably has a thickness of 0.001 to 10 μm, particularly preferably 0.2 to 5 μm. If it is less than 0.001 μm, it is difficult to form the charge generation layer uniformly, while if it exceeds 10 μm, electrophotographic characteristics tend to be lowered. The thickness of the charge transport layer is preferably 5 to 50 μm, particularly preferably 8 to 25 μm. If the thickness is less than 5 μm, initial potential is lowered, while if it exceeds 50 μm, sensitivity tends to be lowered.

In order to form the photoconductive layer on the conductive substrate, there may be employed a method in which an organic photoconductive substance is vapor deposited on a conductive substrate, and a method in which an organic photoconductive substance and, if necessary, other components are uniformly dissolved or dispersed in an aromatic solvent such as toluene and xylene, a halogenated hydrocarbon type solvent such as methylene chloride and carbon tetrachloride, an alcoholic solvent such as methanol, ethanol and propanol, or an ether type solvent such as tetrahydrofuran, 2-methoxyethanol, 2-ethoxyethanol and 2-butoxyethanol to prepare a coating solution for a photoconductive layer and the coating solution obtained is coated on a conductive substrate and dried. As a coating method, a spin coating method and a dip coating method may be employed. The charge generation layer and the charge transport layer may be formed in the same manner by using a coating solution for the charge generation layer and a coating solution for the charge transport layer. In that case, either of the charge generation layer or the charge transport layer may be an upper layer, or the charge generation layer may be sandwiched between two layers of the charge transport layers.

When the phthalocyanine composition of the present invention is coated by the spin coating method, it is preferred that spin coating is carried out at a rotation number of 500 to 4,000 rpm, preferably 500 to 2,000 rpm by using a coating solution obtained by dissolving the phthalocyanine composition and the binder used, if necessary, in a solvent such as chloroform, toluene, tetrahydrofuran and 2-ethoxyethanol. Further, when the composition is coated by the dip coating method, it is preferred that the conductive substrate is immersed in a coating solution obtained by dispersing the phthalocyanine composition and the binder used, if necessary, in the solvent described above by using a ball mill or ultrasonic wave.

The electrophotographic photoreceptor according to the present invention may further have a thin adhesive layer or a barrier layer immediately on the conductive substrate, or may have a protective layer on the surface.

EXAMPLES

In the following, the present invention is described in detail by referring to Preparation examples of phthalocyanine compositions and Examples.

Preparation example 1

In 50 ml of sulfuric acid was dissolved 1 g of a phthalocyanine mixture comprising 0.75 g of titanylphthalocyanine and 0.25 g of chloroindium phthalocyanine, and the mixture was stirred at room temperature for 30 minutes. Subsequently, the mixture was added dropwise to one liter of a deionized water cooled with ice water over about 40 minutes to be reprecipitated. The mixture was further stirred for 1 hour under cooling and left to stand overnight. After the supernatant was removed by decantation, the precipitates were separated by centrifugation to obtain 700 mg of the precipitates. In the first washing, to 700 mg of the precipitates was added 120 ml of a deionized water as a washing water, and the mixture was stirred. Then, the precipitates and the washing water were separated and removed by centrifugation. The same washing operation was carried out successively five times. The pH and conductivity of the washing water (namely washing water after washing) separated and removed in the sixth operation were measured (at 23° C.). The pH was measured by using Model PH51 (trade name, manufactured by Yokogawa Denki Co.). Further, the conductivity was measured by Model SC-17A (trade name, manufactured by Shibata Kagaku Kikai Kogyo Co.). The pH of the washing water was 3.3, and the conductivity was 65.1 μS/cm. Subsequently, the precipitates were washed with 60 ml of methanol three times, and then dried under vacuum by heating at 60° C. for 4 hours. The X-ray diffraction spectrum of the resulting dried product is shown in FIG. 1.

Figure 2:
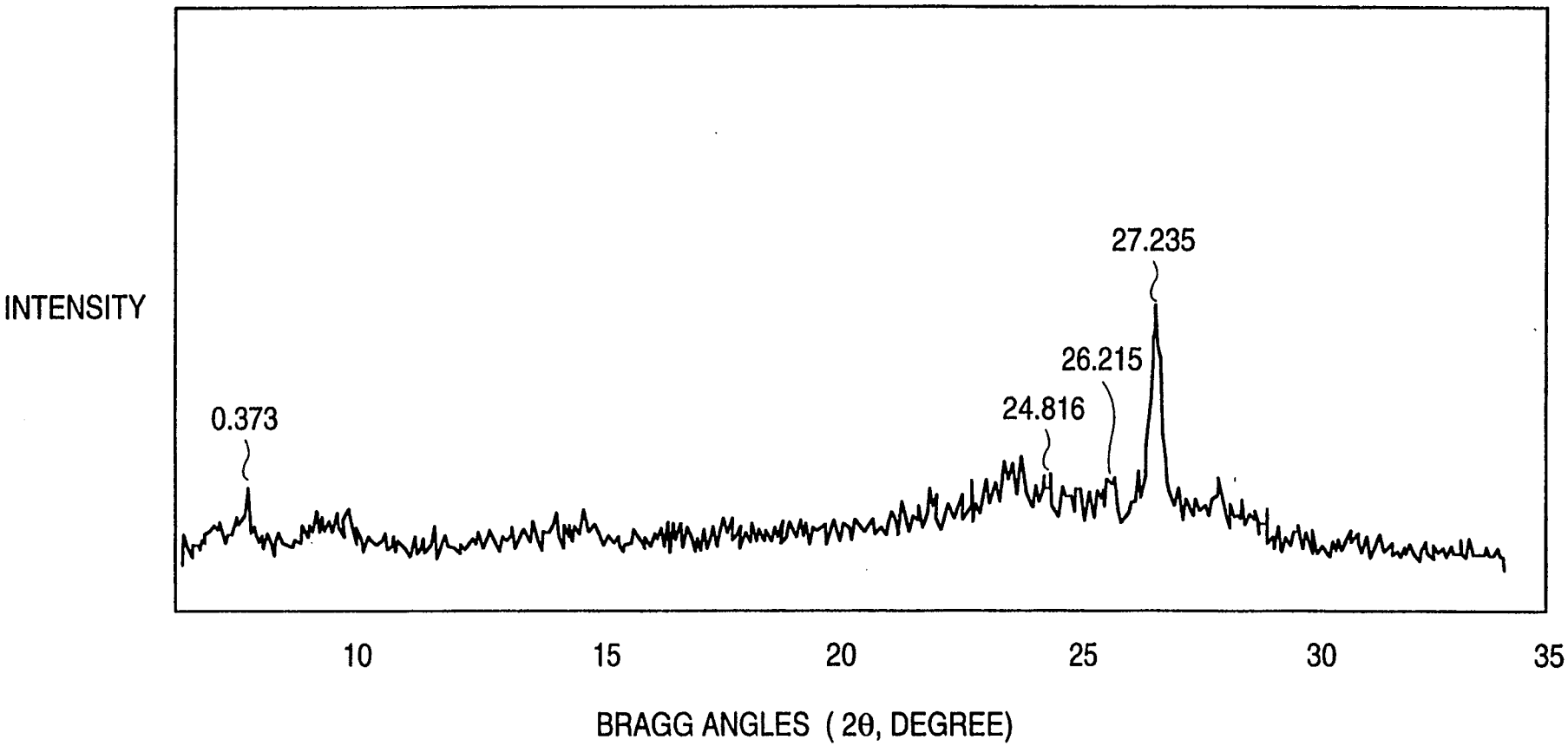
FIG. 2 is an X-ray diffraction spectrum of a phthalocyanine composition obtained in Preparation example 1.

Next, to 1 g of this product dried under vacuum were added 9.0 g of a deionized water and 86 g of toluene, and the mixture was stirred under heating at 60° C. for 8 hours. After the supernatant was removed by centrifugation, the residue was washed with methanol and dried under vacuum by heating at 60° C. for 4 hours to obtain crystal of the phthalocyanine composition of the present invention. The X-ray diffraction spectrum of this crystal is shown in FIG. 2.

Preparation example 2

Figure 3:
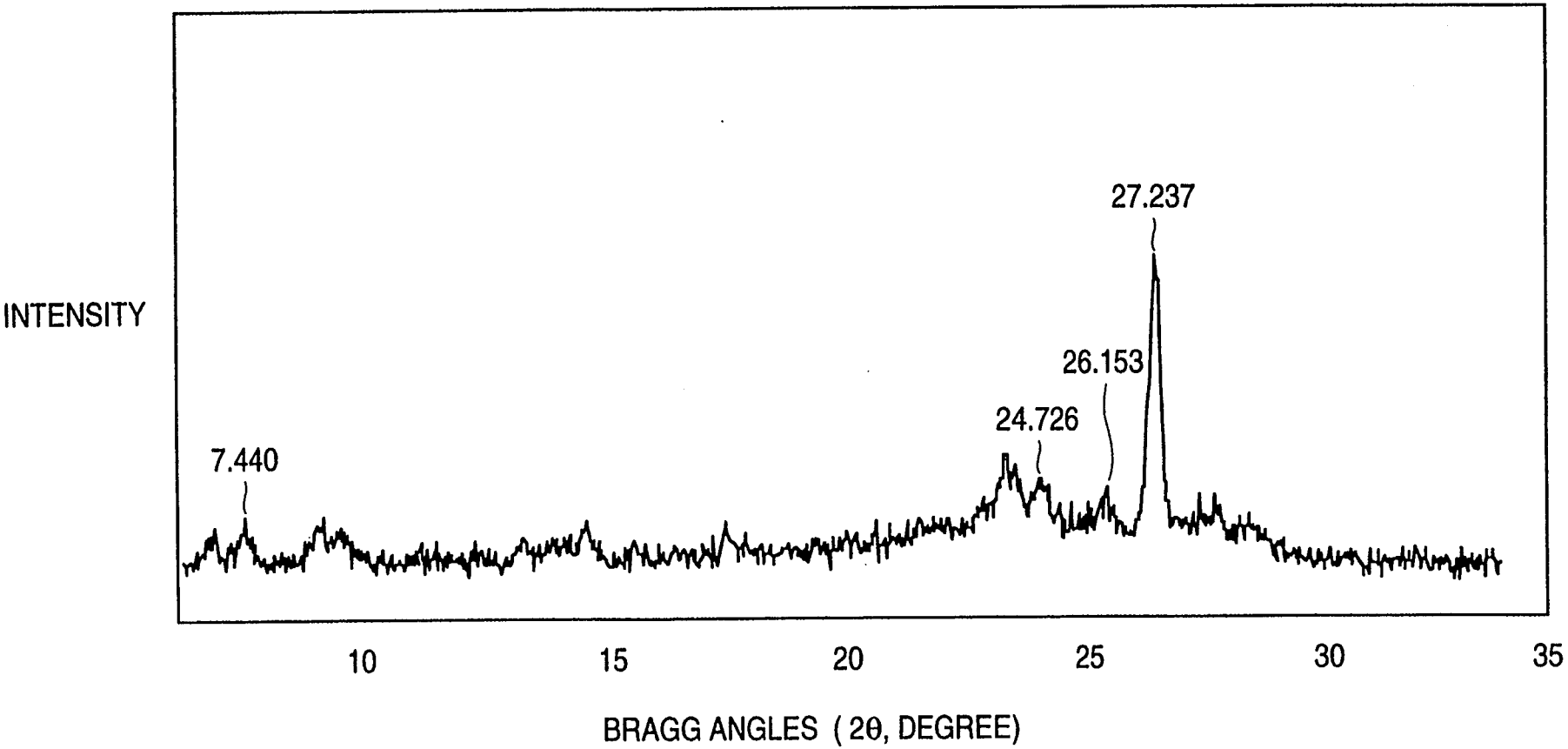
FIG. 3 is an X-ray diffraction spectrum of a phthalocyanine composition obtained in Preparation example 2.

Crystal of the phthalocyanine composition of the present invention was obtained by adding 9.0 g of a deionized water and 86.0 g of xylene to 1.0 g of a product dried under vacuum obtained in the same manner as in Preparation example 1 and stirring the mixture under heating at 60° C. for 8 hours. The X-ray diffraction spectrum of this crystal is shown in FIG. 3.

Preparation example 3

Crystal of the phthalocyanine composition of the present invention was obtained by adding 9.0 g of a deionized water and 87.0 g of benzene to 1.0 g of a product dried under vacuum obtained in the same manner as in Preparation example 1 and stirring the mixture under heating at 60° C. for 8 hours. The X-ray diffraction spectrum of the composition obtained was the same as that in FIG. 2.

Preparation example 4

Crystal of the phthalocyanine composition of the present invention was obtained by adding 9.0 g of a deionized water and 86.0 g of toluene to 1.0 g of a product dried under vacuum obtained in the same manner as in Preparation example 1 and subjecting the mixture to ball mill milling with zirconia beads having a size of 1 mmΦ in a glass bottle at room temperature for 20 hours. The X-ray diffraction spectrum of the composition obtained was the same as that in FIG. 2.

Preparation example 5

Crystal of the phthalocyanine composition of the present invention was obtained by adding 100.0 g of a deionized water and 86.0 g of toluene to 1.0 g of a product dried under vacuum obtained in the same manner as in Preparation example 1 and stirring the mixture under heating at 60° C. for 8 hours. The X-ray diffraction spectrum of the composition obtained was the same as that in FIG. 2.

Preparation example 6

Crystal of the phthalocyanine composition of the present invention was obtained by adding 1.0 g of a deionized water and 86.0 g of toluene to 1.0 g of a product dried under vacuum obtained in the same manner as in Preparation example 1 and stirring the mixture under heating at 60° C. for 8 hours. The X-ray diffraction spectrum of the composition obtained was the same as that in FIG. 2.

Preparation example 7

Crystal of the phthalocyanine composition of the present invention was obtained by adding 9.0 g of a deionized water and 86.0 g of toluene to 1.0 g of a product dried under vacuum obtained in the same manner as in Preparation example 1 and stirring the mixture under heating at 60° C. for 8 hours. The X-ray diffraction spectrum of the composition obtained was the same as that in FIG. 2.

Preparation example 8

Crystal of the phthalocyanine composition of the present invention was obtained by adding 100.0 g of a deionized water and 1.7 g of toluene to 1.0 g of a product dried under vacuum obtained in the same manner as in Preparation example 1 and stirring the mixture under heating at 60° C. for 8 hours. The X-ray diffraction spectrum of the composition obtained was the same as that in FIG. 2.

Comparative preparation example 1

Figure 4:
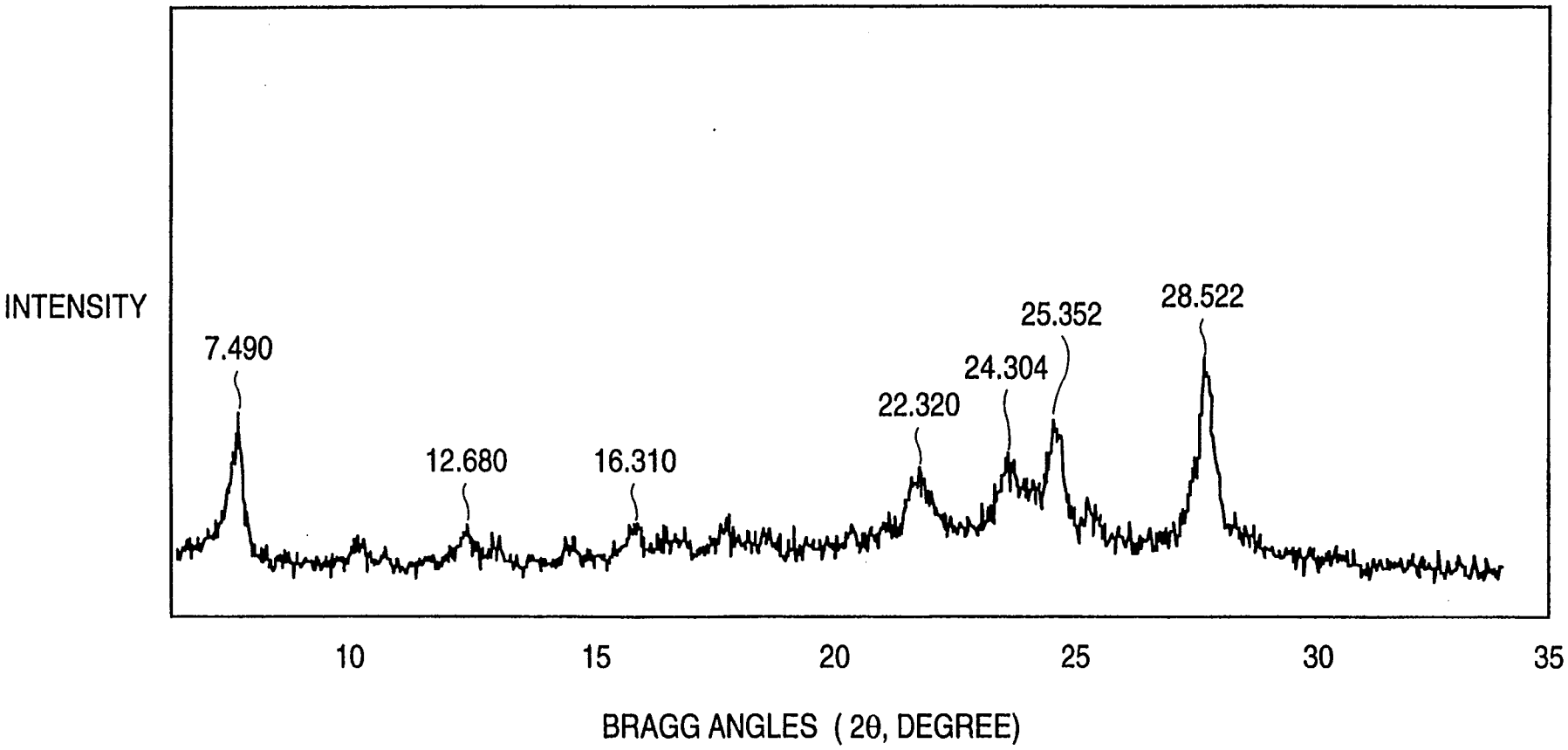
FIG. 4 is an X-ray diffraction spectrum of a phthalocyanine composition obtained in Comparative preparation example 1.

Crystal of a phthalocyanine composition was prepared by adding 86.0 g of toluene to 1.0 g of a product dried under vacuum obtained in the same manner as in Preparation example 1 and stirring the mixture under heating at 100° C. for 1 hour. The X-ray diffraction spectrum of the crystal obtained is shown in FIG. 4.

Comparative preparation example 2

Figure 5:
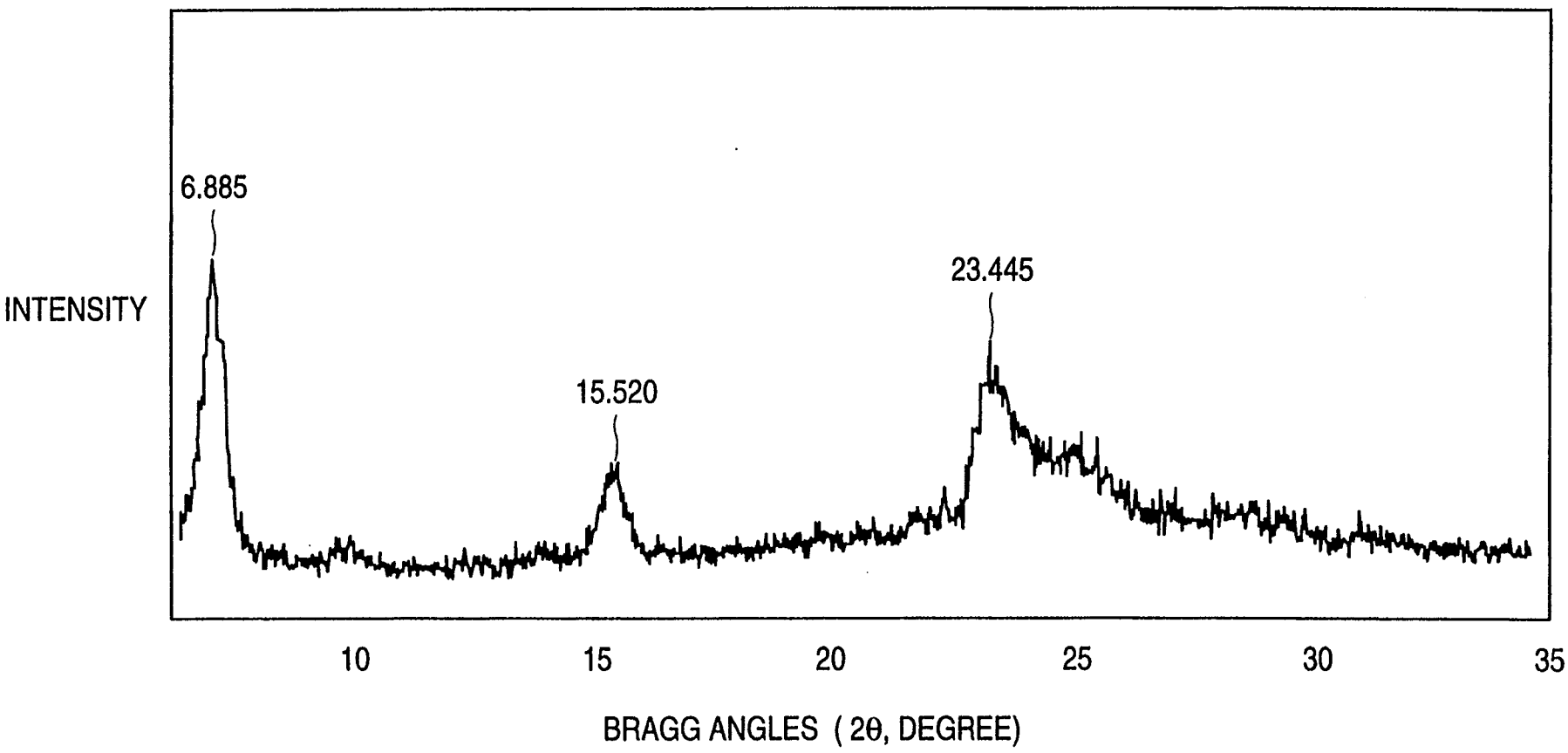
FIG. 5 is an X-ray diffraction spectrum of a product dried under vacuum obtained in Comparative preparation example 2.
Figure 6:
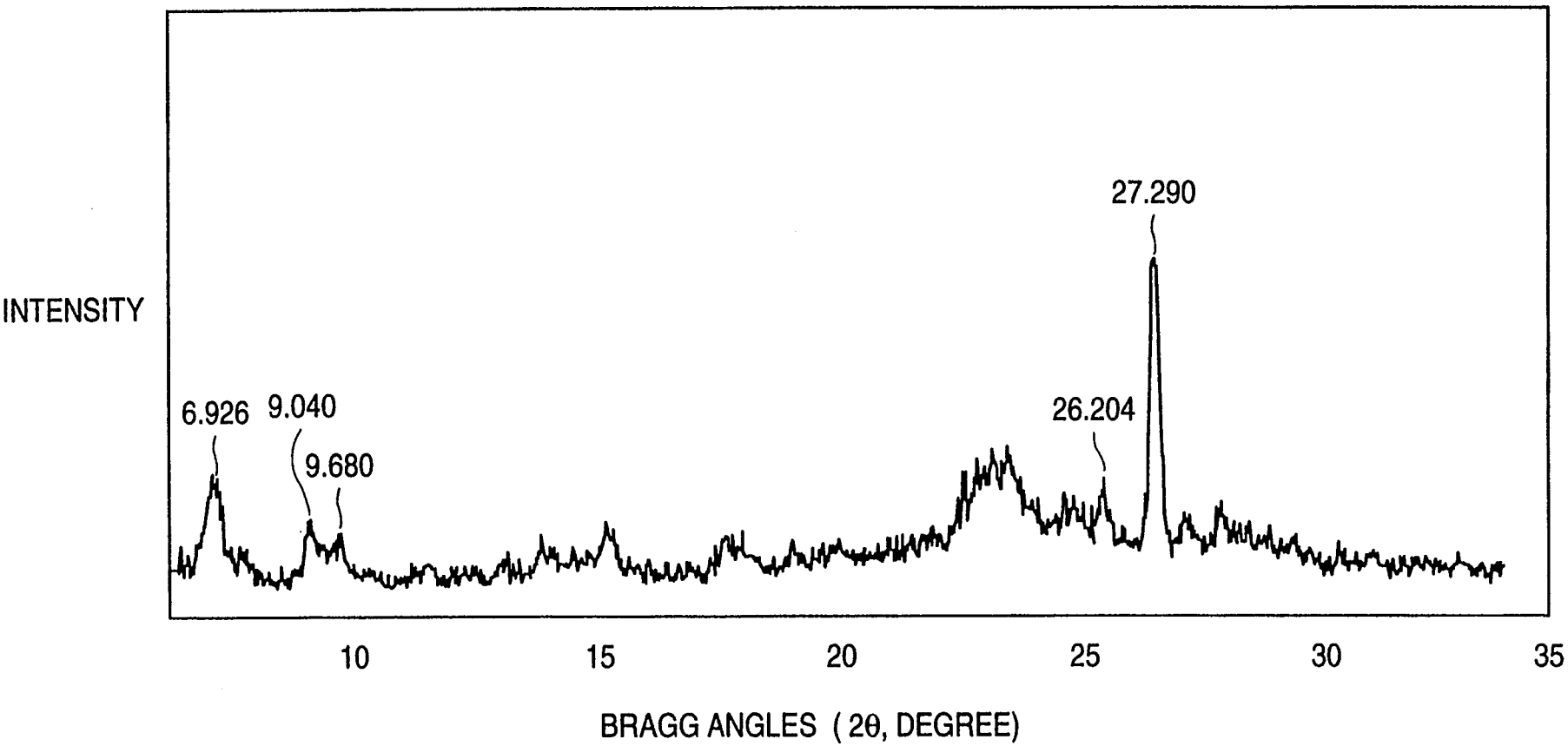
FIG. 6 is an X-ray diffraction spectrum of a phthalocyanine composition obtained in Comparative preparation example 2.

Crystal of a phthalocyanine composition was prepared in the same manner as in Preparation example 1 except for using a phthalocyanine composition showing the X-ray diffraction spectrum of FIG. 5 in place of the product dried under vacuum showing the X-ray diffraction spectrum of FIG. 1. The X-ray diffraction spectrum of the crystal obtained is shown in FIG. 6.

Preparation examples 9 to 16

Crystals of phthalocyanine compositions were obtained according to Preparation examples 1 to 8 except for using bromoindium phthalocyanine in place of chloroindium phthalocyanine.

Comparative preparation examples 3 and 4

Crystals of phthalocyanine compositions were obtained according to Comparative preparation examples 1 and 2 except for using bromoindium phthalocyanine in place of chloroindium phthalocyanine.

Preparation examples 17 to 24

Crystals of phthalocyanine compositions were obtained according to Preparation examples 1 to 8 except for using chlorogallium phthalocyanine in place of chloroindium phthalocyanine.

Comparative preparation examples 5 and 6

Crystals of phthalocyanine compositions were obtained according to Comparative preparation examples 1 and 2 except for using chlorogallium phthalocyanine in place of chloroindium phthalocyanine.

Preparation examples 25 to 32

Crystals of phthalocyanine compositions were obtained according to Preparation examples 1 to 8 except for using chloroaluminum phthalocyanine in place of chloroindium phthalocyanine.

Comparative preparation examples 7 and 8

Crystals of phthalocyanine compositions were obtained according to Comparative preparation examples 1 and 2 except for using chloroaluminum phthalocyanine in place of chloroindium phthalocyanine.

Example 1

Figure 7:
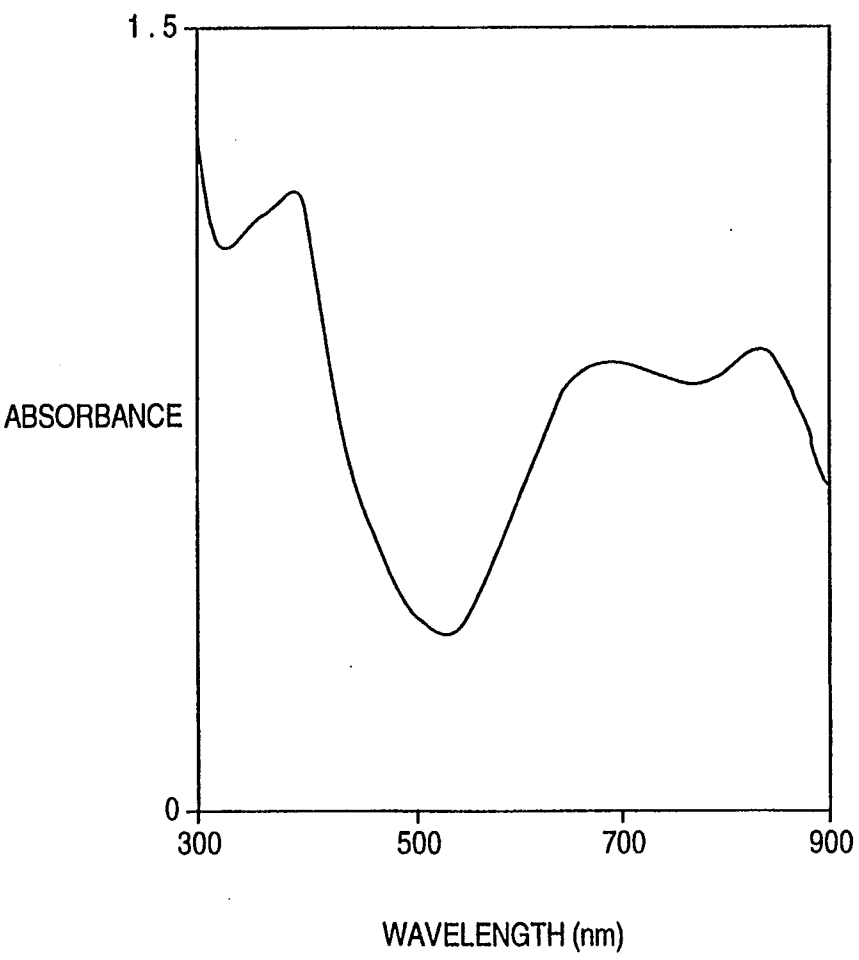
FIG. 7 is an absorption spectrum of a dispersion obtained in Example 1.

1.5 g of the phthalocyanine composition prepared in Preparation example 1, 0.9 g of a polyvinyl butyral resin Ethlec BL-S (trade name, produced by Sekisui Kagaku Co.), 0.1 g of a melamine resin ML351W (trade name, produced by Hitachi Chemical Co., Ltd.), 49.0 g of 2-ethoxyethanol and 49.0 g of tetrahydrofuran were mixed, and the mixture was dispersed by a ball mill. The dispersion obtained was coated on an aluminum plate (conductive substrate, 100 mm×100 mm ×0.1 mm) by the dip coating method, and dried at 140° C. for one hour to form a charge generation layer having a thickness of 0.5 μm. This dispersion was coated on a glass plate and absorption spectrum was measured. The result is shown in FIG. 7. The absorption spectrum was measured by an automatic recording spectrophotometer Model U-3410 (trade name, manufactured by Hitachi, Ltd.).

A coating solution obtained by mixing 1.5 g of the above charge transport substance No. 4, 1.5 g of a polycarbonate resin Upilon S-3000 (trade name, produced by Mitsubishi Gas Kagaku Co.) and 15.5 g of methylene chloride was coated on the above aluminum substrate by the dip coating method, and dried at 120° C. for one hour to form a charge transport layer having a thickness of 20 μm.

Electrophotographic characteristics (sensitivity, residual potential, dark decay rate and responsibility to light) were evaluated by Cynthia 30HC (trade name, manufactured by Midoriya Denki Co.). The photoreceptor was charged up to −650 V by a corona charging system, and the photoreceptor was exposed to monochromatic light of 780 nm for 50 mS. Then, various characteristics were measured. The above characteristics are defined as described below. Sensitivity ($E_{50}$) is an irradiation energy of monochromatic light of 780 nm required for reducing an initial charge potential of −650 V by half at 0.2 second after exposure. Residual potential (Vr) is a potential remaining on the surface of the photoreceptor at 0.2 second or 0.5 second after monochromatic light of 20 mJ/m$^2$ having the same wavelength is exposed for 50 mS. Dark decay rate (DDR) is defined as $(V_1/650)\times 100$ by using −650 V which is an initial charge potential of the photoreceptor and $V_1$ (−V) which is a surface potential after the photoreceptor after initial charging is left to stand in a dark place for 1 second. Responsibility to light ($T_{\frac{1}{2}}$) is defined as a time required for reducing an initial charge potential of −650 V by half after monochromatic light of 20 mJ/m$^2$ having a wavelength of 780 nm is exposed for 50 mS.

Examples 2 to 8

Electrophotographic photoreceptors were prepared and evaluated according to Example 1 except for using the titanylphthalocyanine compositions obtained in Preparation examples 2 to 8. The results are shown in Table 1.

Comparative examples 1 and 2

Figure 8:
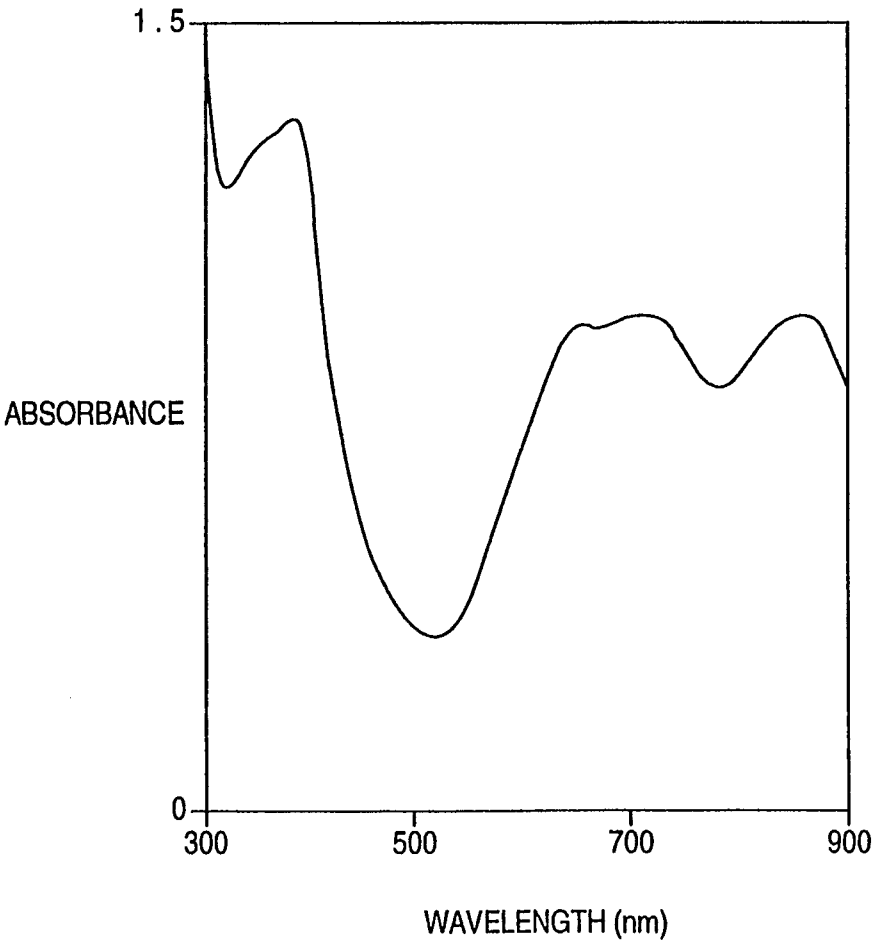
FIG. 8 is an absorption spectrum of a dispersion obtained in Comparative example 1.

Electrophotographic photoreceptors were prepared and evaluated according to Example 1 except for using the titanylphthalocyanine compositions obtained in Comparative preparation examples 1 and 2. The results are shown in Table 1. The photoreceptors apparently had high sensitivity, but dark decay rates thereof were bad so that they could not be used practically. A dispersion using powder obtained in Comparative preparation example 1 was coated on a glass plate, and absorption spectrum was measured. The result is shown in FIG. 8.

Comparative example 3

An electrophotographic photoreceptor was prepared and evaluated according to Example 1 except for using dry powder before treatment with a mixed solvent of toluene and water in Preparation example 1, but it could not be charged up to −650 V.

TABLE 1

| | Charge generation substance | Charge transport substance | Sensitivity ($E_{50}$) (mJ/m$^2$) | Residual potential (Vr0.2) (−V) | Residual potential (Vr0.5) (−V) | Dark decay (DDR) (%) | Responsibility to light ($T_{\frac{1}{2}}$) (mS) |
|---|---|---|---|---|---|---|---|
| Example 1 | Crystal obtained in Preparation example 1 | No. 4 | 2.2 | 31 | 28 | 98.3 | 9.2 |
| Example 2 | Crystal obtained in Preparation example 2 | No. 4 | 2.4 | 39 | 34 | 97.0 | 9.4 |
| Example 3 | Crystal obtained in Preparation example 3 | No. 4 | 2.2 | 54 | 38 | 95.7 | 15.4 |
| Example 4 | Crystal obtained in Preparation example 4 | No. 4 | 2.1 | 35 | 32 | 94.4 | 11.0 |
| Example 5 | Crystal obtained in Preparation example 5 | No. 4 | 2.5 | 28 | 22 | 97.3 | 10.2 |
| Example 6 | Crystal obtained in Preparation example 6 | No. 4 | 2.0 | 32 | 25 | 96.0 | 8.4 |
| Example 7 | Crystal obtained in Preparation example 7 | No. 4 | 2.2 | 20 | 14 | 97.5 | 10.4 |
| Example 8 | Crystal obtained in Preparation example 8 | No. 4 | 2.3 | 24 | 32 | 94.4 | 11.5 |
| Comparative example 1 | Crystal obtained in Comparative preparation example 1 | No. 4 | 1.8 | 51 | 32 | 59.3 | 14.0 |
| Comparative example 2 | Crystal obtained in Comparative preparation example 2 | No. 4 | 4.0 | 118 | 100 | 67.9 | 20.0 |
| Comparative example 3 | Dry powder obtained Preparation example 1 | No. 4 | No charging ability | | | | |

Examples 9 to 16

Electrophotographic photoreceptors were prepared and evaluated according to Examples 1 to 8 except for using the titanylphthalocyanine compositions obtained in Preparation examples 9 to 16 and using Compound No. 2 in place of Compound No. 4 as a charge transport substance. The results are shown in Table 2.

Comparative examples 4 and 5

Electrophotographic photoreceptors were prepared and evaluated according to Example 1 except for using the titanylphthalocyanine compositions obtained in Comparative preparation examples 4 and 5 and using Compound No. 2 in place of Compound No. 4 as a charge transport substance. The results are shown in Table 2.

Comparative example 6

An electrophotographic photoreceptor was prepared and evaluated according to Example 1 except for using dry powder before treatment with a mixed solvent of toluene and water in Preparation example 9, but it could not be charged up to −650 V.

Comparative examples 7 and 8

Electrophotographic photoreceptors were prepared and evaluated according to Example 1 except for using the titanylphthalocyanine compositions obtained in Comparative preparation examples 7 and 8 and using Compound No. 5 in place of Compound No. 4 as a charge transport substance. The results are shown in Table 3.

TABLE 2

| | Charge generation substance | Charge transport substance | Sensitivity ($E_{50}$) (mJ/m$^2$) | Residual potential (Vr0.2) (−V) | Residual potential (Vr0.5) (−V) | Dark decay (DDR) (%) | Responsibility to light (T) (mS) |
|---|---|---|---|---|---|---|---|
| Example 9 | Crystal obtained in Preparation example 9 | No. 2 | 1.9 | 39 | 30 | 93.7 | 9.2 |
| Example 10 | Crystal obtained in Preparation example 10 | No. 2 | 1.8 | 38 | 27 | 92.5 | 10.1 |
| Example 11 | Crystal obtained in Preparation example 11 | No. 2 | 1.9 | 43 | 31 | 93.8 | 12.3 |
| Example 12 | Crystal obtained in Preparation example 12 | No. 2 | 1.6 | 35 | 28 | 90.8 | 9.8 |
| Example 13 | Crystal obtained in Preparation example 13 | No. 2 | 1.3 | 28 | 21 | 97.3 | 9.2 |
| Example 14 | Crystal obtained in Preparation example 14 | No. 2 | 1.9 | 32 | 25 | 97.8 | 9.9 |
| Example 15 | Crystal obtained in Preparation example 15 | No. 2 | 1.4 | 41 | 37 | 94.7 | 11.4 |
| Example 16 | Crystal obtained in Preparation example 16 | No. 2 | 1.5 | 35 | 29 | 94.6 | 10.0 |
| Comparative example 4 | Crystal obtained in Comparative preparation example 4 | No. 2 | 1.8 | 53 | 34 | 60.7 | 13.7 |
| Comparative example 5 | Crystal obtained in Comparative preparation example 5 | No. 2 | 4.8 | 83 | 74 | 80.1 | 18.7 |
| Comparative example 6 | Dry powder obtained in Preparation example 9 | No. 2 | | No charging ability | | | |

EXAMPLES 17 TO 24

Electrophotographic photoreceptors were prepared and evaluated according to Examples 1 to 8 except for using the titanylphthalocyanine compositions obtained in Preparation examples 17 to 24 and using Compound No. 5 in place of Compound No. 4 as a charge transport substance. The results are shown in Table 3.

Comparative example 9

An electrophotographic photoreceptor was prepared and evaluated according to Example 1 except for using dry powder before treatment with a mixed solvent of toluene and water in Preparation example 17, but it could not be charged up to −650 V.

TABLE 3

| | Charge generation substance | Charge transport substance | Sensitivity ($E_{50}$) (mJ/m$^2$) | Residual potential (Vr0.2) (−V) | Residual potential (Vr0.5) (−V) | Dark decay (DDR) (%) | Responsibility to light ($T_1$) (mS) |
|---|---|---|---|---|---|---|---|
| Example 17 | Crystal obtained in Preparation example 17 | No. 5 | 1.8 | 39 | 30 | 98.3 | 6.9 |
| Example 18 | Crystal obtained in Preparation example 18 | No. 5 | 1.9 | 41 | 30 | 97.7 | 6.7 |
| Example 19 | Crystal obtained in Preparation example 19 | No. 5 | 1.8 | 49 | 34 | 98.9 | 10.7 |
| Example 20 | Crystal obtained in Preparation example 20 | No. 5 | 2.0 | 42 | 32 | 96.9 | 10.0 |
| Example 21 | Crystal obtained in Preparation example 21 | No. 5 | 2.7 | 31 | 29 | 97.3 | 9.5 |
| Example 22 | Crystal obtained in Preparation example 22 | No. 5 | 2.9 | 35 | 26 | 96.0 | 9.6 |
| Example 23 | Crystal obtained in Preparation example 23 | No. 5 | 2.6 | 44 | 37 | 97.7 | 12.4 |
| Example 24 | Crystal obtained in Preparation example 24 | No. 5 | 2.5 | 32 | 25 | 98.4 | 11.1 |
| Comparative example 7 | Crystal obtained in Comparative preparation example 7 | No. 5 | 1.8 | 37 | 29 | 57.8 | 13.7 |
| Comparative example 8 | Crystal obtained in Comparative preparation example 8 | No. 5 | 4.2 | 77 | 69 | 72.8 | 15.9 |
| Comparative | Dry powder obtained in | No. 5 | | No charging ability | | | |

TABLE 3-continued

| | Charge generation substance | Charge transport substance | Sensitivity ($E_{50}$) ($mJ/m^2$) | Residual potential (Vr0.2) (−V) | Residual potential (Vr0.5) (−V) | Dark decay (DDR) (%) | Responsibility to light ($T_{\frac{1}{2}}$) (mS) |
|---|---|---|---|---|---|---|---|
| example 9 | Preparation example 17 | | | | | | |

Examples 25 to 32

Electrophotographic photoreceptors were prepared and evaluated according to Examples 1 to 8 except for using the titanylphthalocyanine compositions obtained in Preparation examples 25 to 32 and using Compound No. 1 in place of Compound No. 4 as a charge transport substance. The results are shown in Table 4.

Comparative examples 10 and 11

Electrophotographic photoreceptors were prepared and evaluated according to Example 1 except for using the titanylphthalocyanine compositions obtained in Comparative preparation examples 10 and 11 and using Compound No. 1 in place of Compound No. 4 as a charge transport substance. The results are shown in Table 4.

Comparative example 12

An electrophotographic photoreceptor was prepared and evaluated according to Example 1 except for using dry powder before treatment with a mixed solvent of toluene and water in Preparation example 25, but it could not be charged up to −650 V.

TABLE 4

| | Charge generation substance | Charge transport substance | Sensitivity ($E_{50}$) ($mJ/m^2$) | Residual potential (Vr0.2) (−V) | Residual potential (Vr0.5) (−V) | Dark decay (DDR) (%) | Responsibility to light ($T_{\frac{1}{2}}$) (mS) |
|---|---|---|---|---|---|---|---|
| Example 25 | Crystal obtained in Preparation example 25 | No. 1 | 2.1 | 41 | 35 | 95.8 | 9.3 |
| Example 26 | Crystal obtained in Preparation example 26 | No. 1 | 2.2 | 43 | 34 | 96.3 | 9.7 |
| Example 27 | Crystal obtained in Preparation example 27 | No. 1 | 2.1 | 46 | 39 | 95.5 | 11.1 |
| Example 28 | Crystal obtained in Preparation example 28 | No. 1 | 2.0 | 37 | 30 | 96.5 | 10.7 |
| Example 29 | Crystal obtained in Preparation example 29 | No. 1 | 2.3 | 21 | 15 | 98.3 | 11.2 |
| Example 30 | Crystal obtained in Preparation example 30 | No. 1 | 2.4 | 35 | 27 | 97.0 | 9.9 |
| Example 31 | Crystal obtained in Preparation example 31 | No. 1 | 2.1 | 40 | 34 | 97.6 | 12.4 |
| Example 32 | Crystal obtained in Preparation example 32 | No. 1 | 2.2 | 28 | 19 | 95.9 | 10.0 |
| Comparative example 10 | Crystal obtained in Comparative preparation example 10 | No. 1 | 1.9 | 58 | 46 | 59.9 | 15.3 |
| Comparative example 11 | Crystal obtained in Comparative preparation example 11 | No. 1 | 4.2 | 88 | 76 | 54.9 | 15.3 |
| Comparative example 12 | Dry powder obtained in Preparation example 25 | No. 1 | | No charging ability | | | |

The electrophotographic photoreceptor using the phthalocyanine composition of the present invention has excellent electrophotographic characteristics such as charging characteristics, dark decay and sensitivity so that it can be applied suitably to an electrophotographic process in which density and image quality higher than those of the prior art are demanded.

We claim:

1. A phthalocyanine composition having main diffraction peaks at 7.5°, 24.2° and 27.3° of Bragg angles ($2\theta \pm 0.2°$) in an X-ray diffraction spectrum with Cu Kα, which comprises a mixed crystal of a titanylphthalocyanine and a halogenated metal phthalocyanine wherein the titanylphthalocyanine and the halogenated metal phthalocyanine are mixed in an amount of 20 to 95% by weight of the titanylphthalocyanine and the halogenated metal phthalocyanine as the remainder.

2. The composition according to claim 1, wherein said halogenated metal phthalocyanine is a monohalogen metal phthalocyanine or a monohalogen metal halogen phthalocyanine in which a central metal is trivalent.

3. The composition according to claim 1, wherein said composition has an absorbance at 800 to 830 nm larger than that at 620 to 660 nm.

4. A process for preparing a phthalocyanine composition having main diffraction peaks at 7.5°, 24.2° and 27.3° of Bragg angles ($2\theta \pm 0.2°$) in an X-ray diffraction spectrum with Cu Kα, which comprises precipitating a phthalocyanine mixture containing titanylphthalocyanine and a halogenated metal phthalocyanine in which a central metal is trivalent in water by an acid pasting method to obtain precipitates having a characteristic diffraction peak at 27.2° of Bragg angles ($2\theta \pm 0.2°$) in an X-ray diffraction spectrum with Cu Kα, and subsequently treating the precipitates with a mixed solvent of an aromatic organic solvent and water.

5. The process according to claim 4, wherein a weight ratio of the aromatic organic,solvent to water to be mixed is 1/99 to 99/1.

6. An electrophotographic photoreceptor having a photoconductive layer containing an organic photoconductive substance on a conductive substrate, in which the organic photoconductive substance is a phthalocyanine composition having main diffraction peaks at 7.5°, 24.2° and 27.3° of Bragg angles ($2\theta \pm 0.2°$) in an X-ray diffraction spectrum with Cu K$\alpha$.

7. The photoreceptor according to claim 6, wherein the phthalocyanine composition shows an absorption spectrum in which an absorbance at 800 to 830 nm is larger than that at 620 to 660 nm.

8. The photoreceptor according to claim 6, wherein said composition is a mixed crystal of a titanylphthalocyanine and a halogenated metal phthalocyanine.

9. The photoreceptor according to claim 8, wherein said halogenated metal phthalocyanine is a monohalogen metal phthalocyanine or a monohalogen metal halogen phthalocyanine in which a central metal is trivalent.

10. The photoreceptor according to claim 8, wherein the titanylphthalocyanine and the halogenated metal phthalocyanine are mixed in an amount of 20 to 95% by weight of the titanylphthalocyanine and the halogenated metal phthalocyanine as the remainder.

11. A double-layered type electrophotographic photoreceptor having a charge generation layer containing the phthalocyanine composition according to claim 1 as a charge generation substance and a charge transport layer containing a benzidine derivative represented by the formula (I):

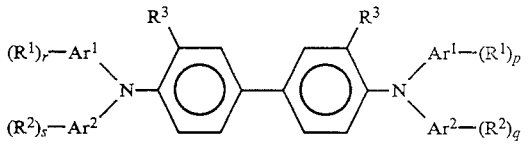

(I)

wherein $R^1$ and $R^2$ each independently represent a hydrogen atom, a halogen atom, an alkyl group, an alkoxy group, an aryl group, a fluoroalkyl group or a fluoroalkoxy group, two $R^3$s each independently represent a hydrogen atom or an alkyl group, $Ar^1$ and $Ar^2$ each independently represent an aryl group, and p, q, r and s each independently represent an integer of 0 to 5.

12. A coating solution for forming a charge generation layer containing the phthalocyanine composition according to claim 1.

* * * * *